US007802625B2

(12) United States Patent
Daniels et al.

(10) Patent No.: US 7,802,625 B2
(45) Date of Patent: Sep. 28, 2010

(54) SYSTEM AND METHOD FOR PRODUCING A WELL USING A GAS

(75) Inventors: Danny K. Daniels, Tishomingo, OK (US); John A. Bibaeff, Jr., Lafayette, LA (US)

(73) Assignee: Nitro-Lift Hydrocarbon Recovery Systems, LLC, Tishomingo, OK (US)

( * ) Notice: Subject to any disclaimer, the term of this patent is extended or adjusted under 35 U.S.C. 154(b) by 35 days.

(21) Appl. No.: 12/291,404

(22) Filed: Nov. 11, 2008

(65) Prior Publication Data

US 2010/0116491 A1 May 13, 2010

(51) Int. Cl.
*E21B 43/18* (2006.01)

(52) U.S. Cl. ..... 166/372; 166/75.12; 166/90.1; 166/252.1; 166/266; 166/267

(58) Field of Classification Search ..... None
See application file for complete search history.

(56) References Cited

U.S. PATENT DOCUMENTS 4,711,306 A 12/1987 Bobo
4,787,450 A 11/1988 Andersen
7,063,161 B2 6/2006 Butler
7,100,695 B2 9/2006 Reitz
2005/0034852 A1 * 2/2005 Irwin, Jr. ..... 166/57
2006/0054318 A1 3/2006 Sarada

* cited by examiner

*Primary Examiner*—Zakiya W. Bates
(74) *Attorney, Agent, or Firm*—The Matthews Firm

(57) ABSTRACT

Systems and methods for producing a well using a gas are disclosed herein. A compressed lift gas can be provided to a well to obtain a production stream. The production stream can be separated to obtain the product and a recycle gas stream. The recycle gas stream can be immediately recompressed for use as lift gas, or separated to form a lift gas stream, and a power stream containing natural gasses from the well. The lift gas stream is recycled for use as lift gas, while the power stream can be transported and/or collected for sale, recycled for use as lift gas, or consumed as power for the compressor, based on measurements obtained throughout the system, coupled with practical and economic variables. By supplementing or replacing generated lift gas and/or an external power source with natural gas from the well, the present systems and methods can become self-contained after start-up.

19 Claims, 2 Drawing Sheets

SYSTEM AND METHOD FOR PRODUCING A WELL USING A GAS

FIELD

The present embodiments relate, generally, to self-contained systems and methods for improving production of a well using a gas.

BACKGROUND

When producing a well, hydrocarbons or other fluids to be recovered are provided with a natural lift due to dissolved gasses within the fluid, which facilitates recovery of the fluid. However, during production, this natural lift diminishes and eventually ceases, requiring other methods to be undertaken to continue producing from a reservoir.

To simulate the lifting effect of natural gasses, one or more compressed gasses, known as lift gasses, can be injected into a well to reduce the density of the hydrocarbon fluid, or other fluid to be recovered. Typically, a substantially non-combustible, non-condensible, inert gas that will not react with, corrode, or degrade well equipment or compounds within the well, and will not support significant microbial growth, such as nitrogen, is utilized.

The equipment required to generate, compress, inject, and recover lift gas, is expensive and bulky, which can be a significant drawback when space on or proximate to a well is limited. Further, the fuel reservoirs or other power sources necessary to utilize such equipment are also expensive and cumbersome.

It is often economically disadvantageous to produce a well using a lift gas. Frequently, the value of the fuel required to generate and compress the lift gas exceeds that of the product recovered from the well. A significant quantity of energy is required to compress enough nitrogen, or another gas, to extract product from a well. The energy costs, coupled with the costs required to transport fuel to the well to power the lift gas operation, can cause a production operation to become prohibitively expensive.

A separator can be used to separate lift gas from the extracted product, enabling the lift gas to be recycled and recompressed. However, even when recycled lift gas is used, a significant percent of the initial lift gas, such as fifteen percent, or more, is normally lost and must be regenerated, and a significant amount of recompression of the recycled gas is usually required.

When producing a hydrocarbon well using a lift gas, it is common for natural gas from the well to become mixed with the lift gas, and remain entrained with the lift gas after the produced fluid hydrocarbons have been separated.

A need exists for a system and method that can selectively separate the natural gas from the lift gas, and depending on the economic viability of each alternative, can selectively: 1) recycle and compress the gas, thereby conserving the costs associated with the production and compression of lift gas; 2) collect the natural gas for sale; or 3) use the natural gas to provide power for compressing the lift gas, thereby conserving costs related to fuel use, storage, and transport.

A further need exists for a system and method that can seamlessly and intelligently alternate between each aforementioned alternative, depending on changes in both the practical and economic viability of each alternative.

The present embodiments meet these needs.

SUMMARY

In an embodiment, the present system can include a gas generator for supplying a lift gas to a well, to obtain a production stream. The gas generator can include a low pressure, self-generating nitrogen generator. However, in addition to nitrogen, other gasses are also usable, such as natural gas, helium, hydrogen, krypton, argon, or other similar gasses. Preferably, a non-corrosive, non-condensible, oxygen-free gas can be used, to prevent damage or degradation to any well equipment or compounds from the well and to prevent microbial growth.

In an embodiment, the lift gas can initially include nitrogen or a similar gas produced by the gas generator at start-up, however, after the system has been in operation, at least a portion of the lift gas can be obtained from recycled gas separated from the production stream from the well.

A compressor can pressurize the lift gas prior to providing the lift gas to the well. In an embodiment, the lift gas can be compressed to a pressure ranging from 1500 pounds per square inch to 4300 pounds per square inch.

In an embodiment, dual compressors can be used, a first compressor compressing the atmosphere and communicating the nitrogen from the atmosphere to the second compressor, while the second compressor raises the pressure of the nitrogen prior to injection into the well. The first compressor can remain idle much of the time to conserve energy, and can be activated only when the volume of nitrogen in the system has become depleted.

A power source, such as a diesel fuel reservoir or similar source of energy, can be used to provide power to the gas generator, the compressor, or combinations thereof. In an embodiment, the power source can be used to drive the compressor initially, at start-up, but after the system has been in operation, at least a portion of the power for the compressor can be obtained from natural gas that has been recycled from the production stream from the well.

A first separator can be used to receive and separate the production stream from the well. In an embodiment, the first separator can be a three-phase separator, which can include a retention vessel that uses gravity to separate the production stream, forming a waste stream, which can include water and other waste materials, a product, such as a hydrocarbon fluid, and a recycle gas stream, which can include recycled lift gas entrained with natural gasses from the well.

While the recycled gas can be communicated directly to the compressor for re-injection into the well, thereby conserving lift gas and the energy required to create the lift gas, the recycled gas can also be selectively communicated to a second separator. In an embodiment, the second separator can be a pressure swing absorption separator.

The pressure swing absorption separator can mechanically separate mixtures of pressurized gases using one or more permeable membranes configured to remove nitrogen, or another gas used as the initial lift gas, from the recycle gas stream. In addition to or in lieu of a three-phase separator and/or a pressure swing absorption separator, one or more other separation apparatuses or techniques can be used.

The second separator can separate the recycle gas stream to form a power stream, which can include natural gas, and a lift gas stream, which can include nitrogen or another gas used as the initial lift gas. The lift gas stream can be communicated to the compressor for re-injection into the well, while the power stream can be selectively manipulated depending on a variety of factors.

One or more measuring devices can be used to determine the contents and/or the volume of the lift gas stream, the recycle gas stream, the power stream, or combinations thereof. For example, if it is determined that the power stream does not contain saleable, 900 btu per cubic foot natural gas, or if it is determined that the cost of producing and compressing additional lift gas exceeds the value of the amount of natural gas contained in the power stream, the power stream can be communicated to the compressor for re-injection into the well as lift gas.

Conversely, if it is determined that the power stream contains saleable natural gas, and it is economically viable to collect, store, and/or transport the natural gas for sale, given the cost to compress additional lift gas, the power stream can be collected for sale.

Alternatively, if it is determined that the cost of power for the compressor exceeds the value of the natural gas, both as a saleable product and as a lift gas, the natural gas can be used as an alternate power source for the compressor to conserve fuel costs. If a sufficient amount of natural gas is continuously extracted from the well, the present system can become entirely self-contained, such that little or no external energy is required to provide power to the compressor outside of that obtained from the natural gas. Further, if a sufficient amount of natural gas is obtained, the need for the generation of additional lift gas can also be minimized or eliminated.

In an embodiment, the present system can include a controller usable to selectively actuate a plurality of valves disposed between the gas generator, compressor, power source, separators, and one or more measuring devices. The controller can include a processor in communication with computer software usable to automatically actuate one or more of the valves, or to prompt manual actuation of the valves through the provision of notices and/or information.

Specifically, the controller is usable to selectively actuate valves to provide power to the gas generator, to direct the lift gas to the well, to divert the lift gas to a collector, to remove the waste stream from the system, to direct the product to a collector, to direct the recycle gas stream to the compressor, to direct the recycle gas stream to the second separator, to divert the recycle gas stream to a collector, to direct the power stream to the compressor for use as power, to direct the power stream to the compressor for use as lift gas, to divert the power stream to a collector, or combinations thereof.

Through use of an intelligent controller, the present system is usable to calculate the economic viability of each possible alternative use of the lift gas, the recycle gas stream, the power stream, or combinations thereof, by obtaining measurements from the measuring devices and comparing the measurements with predetermined or continuously monitored and/or changing parameters.

In an embodiment, the present system can include one or more transportable members, such as skids, which contain the gas generator, compressor, power source, separators, measuring devices, or combinations thereof. Use of transportable members enables the present system to be efficiently and conveniently transported between wells and other destination sites, and rapidly installed or disassembled, as needed. Through use of transportable members, the present system can be transported using one to two trucks and/or trailers.

The present embodiments also relate to a self-contained method for producing a well using a gas. The method can include providing a compressed lift gas to a well to obtain a production stream, and separating the production stream to form a product and a recycle gas stream.

The recycle gas stream can be separated to form a power stream and a lift gas stream. At least a portion of the power stream can be used to provide power for compressing the lift gas stream to form the compressed lift gas for provision to the well.

In an embodiment, the contents and/or volume of the compressed lift gas, the recycle gas stream, the power stream, or combinations thereof, can be measured, and the measured gas stream can be selectively diverted based on the measurement.

The present system and method thereby provide a self-contained means by which a well can be produced using a lift gas, while depleted lift gas and/or the power requirements of the system can be supplemented using natural gas obtained from the well during production.

BRIEF DESCRIPTION OF THE DRAWINGS

In the detailed description of the embodiments presented below, reference is made to the accompanying drawings, in which.

The present embodiments are detailed below with reference to the listed Figures.

DETAILED DESCRIPTION OF THE EMBODIMENTS

Before explaining the present embodiments in detail, it is to be understood that the embodiments are not limited to the particular descriptions and that the embodiments can be practiced or carried out in various ways.

Figure 1:
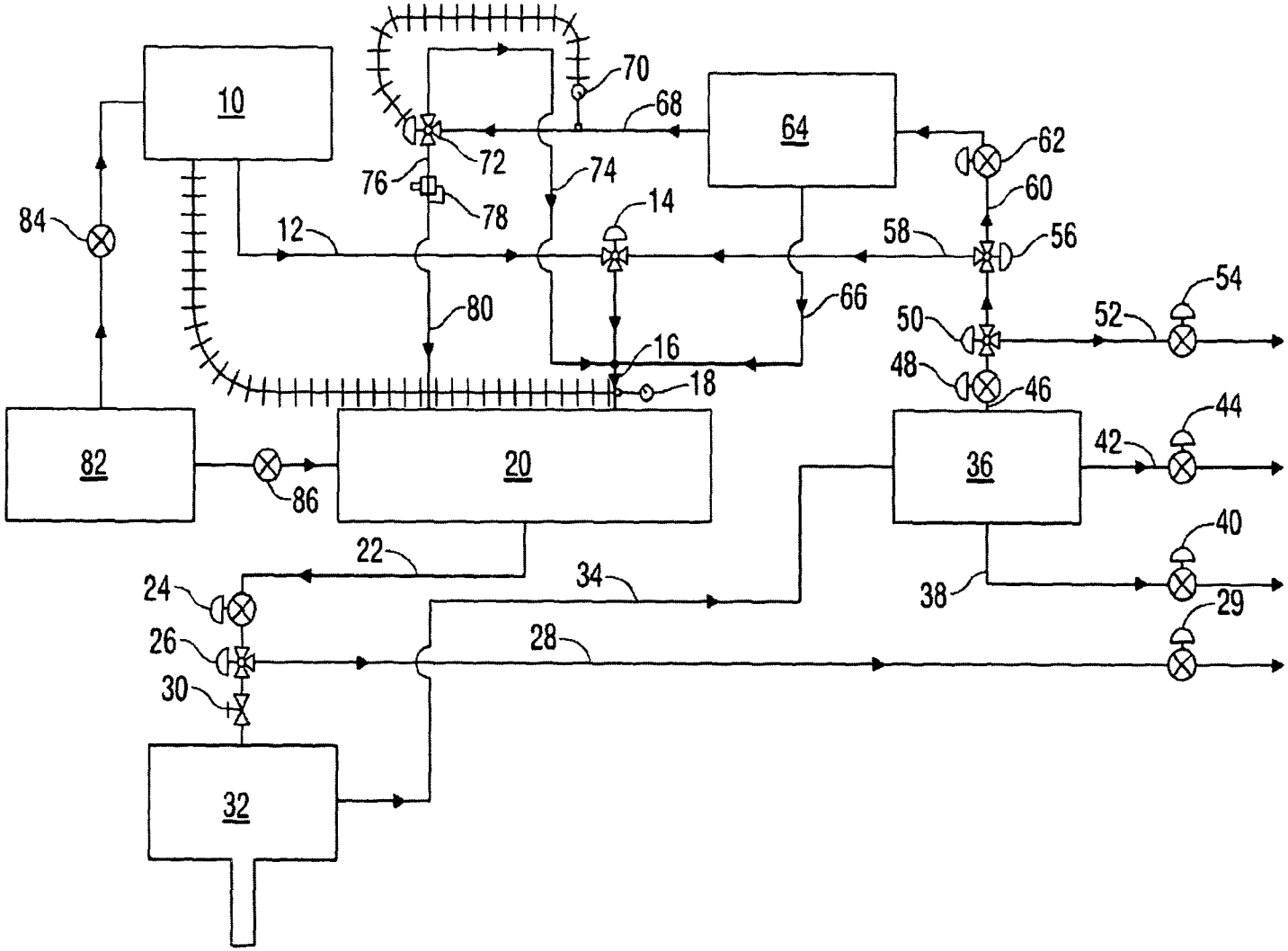
FIG. 1 depicts a diagram of an embodiment of the present system for improving production of a well.

Referring now to FIG. 1, a diagram of an embodiment of the present system is depicted. FIG. 1 illustrates one embodiment of a gas lift system, the primary components including a lift gas source (10), a compressor (20), a three-phase separator (36), and a pressure swing absorption separator (64), which can be connected using a plurality of lines or similar conduits, with a plurality of three-way valves (14, 26, 50, 56, 72) for directing gas flows throughout the system.

FIG. 1 shows the lift gas source (10), such as a nitrogen generator, for producing and flowing a generated gas stream (12) to the compressor (20). In an embodiment, the lift gas source (10) can be a diesel-powered, low pressure, self-generating nitrogen generator, capable of producing 200,000 SCF/day, or more, of nitrogen gas at 150 psig. Other gasses are also usable, however it is preferable to use a generally inert, non-condensible, oxygen-free gas that will not react with, corrode, degrade, or otherwise negatively affect any system equipment or well compounds, and will not support microbial growth.

The lift gas source (10) can be powered by a power source (82), such as a diesel fuel tank or similar source of fuel. A first fuel valve (84) is shown disposed between the power source (82) and the lift gas source (10), for selectively providing fuel to the lift gas source (10).

A first three-way valve (14) is shown disposed between the lift gas source (10) and the compressor (20). The first three-way valve (14) is usable to selectively direct the generated gas stream (12) to the compressor (20).

A pressure transducer (18) or similar measuring device can also be disposed between the lift gas source (10) and the compressor (20) for determining the current pressure within the system, and thereby the current demand for additional lift gas. The lift gas source (10) can be selectively actuated to generate more gas for addition to the generated gas stream (12) based on the measurement indicated by the pressure transducer (18). The pressure transducer (18) can be used to ensure that the pressure within the system does not decrease, due to lost gas, to a degree that could damage any of the system components.

The compressor (20) can compress received gasses to a pressure of 1500 psig, or more, depending on the operations to be undertaken. For some applications, the pressure of the received gasses can be increased to 4000 to 4300 psig. In an embodiment, the compressor (20) can be a bi-fuel capable diesel driven booster compressor system, that can be powered using diesel fuel, natural gas, or combinations thereof, with a capacity of 2000 MCF per day, or more, at a pressure of 1500 psig, or more.

FIG. 1 depicts the power source (82) in communication with the compressor (20), with a second fuel valve (86) disposed therebetween, for selectively providing fuel to the compressor (20).

In an embodiment, the compressor (20) can be integral with the lift gas source (10). In another embodiment, the compressor (20) can include dual compressors, a first compressor usable to compress the atmosphere and communicate the nitrogen from the compressed atmosphere to a second compressor, which compresses the nitrogen to the desired pressure.

A compressed lift gas stream (22) is flowed from the compressor (20) through a first high pressure gas flow meter (24), which monitors the discharge rate of the compressed lift gas stream (22) from the compressor (20). A second three-way valve (26) can selectively direct the compressed lift gas stream (22) toward the well (32), or can divert the compressed lift gas stream (22) for collection.

For example, if it is determined that the compressed lift gas stream (22) contains a saleable quantity of natural gas, the second three-way valve (26) can permit a diverted compressed lift gas stream (28) to flow past a second high pressure gas flow meter (29), which monitors the flow of the diverted compressed lift gas stream (28), to a high pressure gas sales line or collector.

If not diverted for sale, the compressed lift gas stream (22) is flowed through the second three-way valve (26) to the well (32). FIG. 1 depicts an adjustable choke (30) disposed between the second three-way valve (26) and the well (32) for controlling the pressure of the compressed lift gas stream (22), depending on the needed pressure for producing the well (32).

The well (32) can include any sundry manner of gas lift systems, gas lift equipment, and/or production equipment known in the art, depending on the nature of the production operations undertaken.

The injection of the compressed lift gas stream (22) into the well (32) enables the extraction of a production stream (34) from the well (32). The production stream (34) can contain any combination of the lift gas, a hydrocarbon fluid product, natural gas from the well (32), and one or more waste products, such as water.

FIG. 1 depicts the production stream (34) communicated from the well (32) to a three-phase separator (36), which, in an embodiment, can be a retention time-based separator that uses gravity to separate the production stream (34) into a waste stream (38), a hydrocarbon fluid product (42), and a recycle gas stream (46).

The waste stream (38), which can include primarily water and any other heavy wastes, solids, or similar impurities, is flowed from the three-phase separator (36) through a first low pressure flow meter (40), which monitors the flow of waste water and other components of the waste stream (38) to a collector, a waste line or system, or a similar appropriate location for deposition of waste water and/or other waste.

The hydrocarbon fluid product (42) is flowed from the three-phase separator (36) through a second low pressure flow meter (44), which monitors the flow of the hydrocarbon fluid product (42), to a sales line, a collector, or a similar destination for collection and/or sale.

The recycle gas stream (46) can include recovered lift gas, as well as one or more gasses from the well (32), including usable natural gas. The recycle gas stream (46) is flowed from the three-phase separator (36) through a first low pressure gas flow meter (48), which obtains measurements usable to direct the flow of the recycle gas stream (46).

A third three-way valve (50) is usable to divert the recycle gas stream (46) for sale or collection, such as when it is determined that the recycle gas stream (46) contains a saleable quantity and quality of natural gas. The third three-way valve (50) can permit a diverted recycle gas stream (52) to flow through a second low pressure gas flow meter (54), which monitors the flow of the diverted recycle gas stream (52) to a low pressure gas sales line or collector.

If the recycle gas stream (46) is not diverted for collection or sale, the third three-way valve (50) can direct the recycle gas stream (46) to a fourth three-way valve (56), which can in turn direct the recycle gas stream (46) based on the measurement obtained by the first low pressure gas flow meter (48).

For example, if it is determined that the recycle gas stream (46) does not contain a significant amount of natural gas, or if the value of the natural gas does not exceed the value of the fuel required to produce additional lift gas, the fourth three-way valve (56) can direct the recycle gas stream (46) toward the first three-way valve (14) as a recycled lift gas stream (58).

The recycled lift gas stream (58) can be combined with the generated gas stream (12) from the lift gas source (10), as it flows through the first three-way valve (14), as a lift gas stream (16), to the compressor (20).

Alternatively, the fourth three-way valve (56) can direct the recycle stream (46) through a third low pressure gas flow meter (62), which monitors the flow of the directed recycle gas stream (60), to a pressure swing absorption separator (64).

In an embodiment, the pressure swing absorption separator (64) can be a membrane-based separator that accelerates the directed recycle gas stream (60) while using a membrane to separate nitrogen, or another initial lift gas, from the natural gas and/or other gasses obtained from the well (32). The directed recycle gas stream (60) can be separated to form a recovered lift gas stream (66) and a separated well gas stream (68).

The recovered lift gas stream (66) is directed from the pressure swing absorption separator (64) to the compressor (20), during which the recovered lift gas stream (66) can combine with the generated gas stream (12) and/or recycled lift gas stream (58). The separated well gas stream (68) is directed through a gas BTU value analyzer (70) or similar measuring device, which monitors the output of the separated well gas stream (68) and determines the BTU value of any natural gas contained therein.

Based on the measurement obtained by the BTU value analyzer, the separated well gas stream (68) can be directed by a fifth three-way valve (72). The fifth three-way valve (72) can direct the separated well gas stream (68) toward the compressor (20) as a recycled well gas stream (74), where the recycled well gas stream (74) can combine with the generated gas stream (12), the recycled lift gas stream (58), and/or the recovered lift gas stream (66) prior to compression, thereby conserving the fuel and lift gas required to produce additional generated gas using the lift gas source (10). Additionally, the separated well gas stream (68) directed toward the compressor (20) can be diverted for sale or collection after passing through the second three-way valve (26), which can direct the gas toward a high pressure gas sales line or collector, as described previously.

Alternatively, if it is determined that the value of the fuel required to power the compressor (20) exceeds the value of the separated well gas stream (68), the fifth three-way valve (72) can divert the separated well gas stream (68) toward the compressor (20) as a power stream (80). The power stream (80) passes through one or more pressure-reducing valves (78), which reduce the pressure of the power stream (80) to accommodate the requirements of a power input of the compressor (20). The power stream (80) is then fed into the compressor (20) as fuel, thereby conserving the diesel fuel or other fuel from the power source (82) required to power the compressor (20).

The present system can thereby utilize recovered natural gas from the well (32) for a variety of purposes, each of which enable the present system to become self-contained shortly after start-up. Natural gas can be directed for sale or collection following separation from the hydrocarbon product, using the third three-way valve (50). The natural gas can be recirculated for use as lift gas using the fourth three-way valve (56), the fifth three-way valve (72), or combinations thereof. Recirculated lift gas can be diverted for sale or collection using the second three-way valve (26). Alternatively, the natural gas can be used as power for the compressor (20).

The present system can thereby enable lift gas and the fuel required to power the lift gas source (10) to be conserved through recycling of gas from the well (32) for use as lift gas. The present system can further enable the fuel required to power the compressor (20) to be conserved through use of gas from the well (32) as a power source for the compressor (20). The present system can further collect and transport gas from the well (32) for sale.

As the economic viability of each of these alternative uses for gas recovered from the well (32) changes, the present system can seamlessly select among the alternative uses through automatic or manual manipulation of the three-way valves (14, 26, 50, 56, 72). If a sufficient quantity of natural gas is recovered from the well (32), both the need for externally generated lift gas from the lift gas source (10) and the need for external power for the compressor (20) from the power source (82) can be reduced or eliminated, creating a self-contained system. Due to the costs inherent in the transport and sale of natural gas, use of the natural gas to create a self-contained system is often a more economically viable use for the recovered gas. In situations where the collection and/or sale of the natural gas becomes a more economical alternative, the gas can instead be sold.

In an embodiment, each of the three way valves (14, 26, 50, 56, 72) can be automatically actuated, such as through use of a processor-driven controller, which can be programmed with preset values and thresholds and/or programmed to monitor the real-time economic viability of each use of the obtained natural gas, and compare these values with measurements obtained from one or more of the measuring devices (18, 24, 29, 40, 44, 48, 54, 62, 70). Based on the obtained measurements and the preset and/or real time values, the present system can automatically undertake the most practical or economically viable activity.

Figure 2:
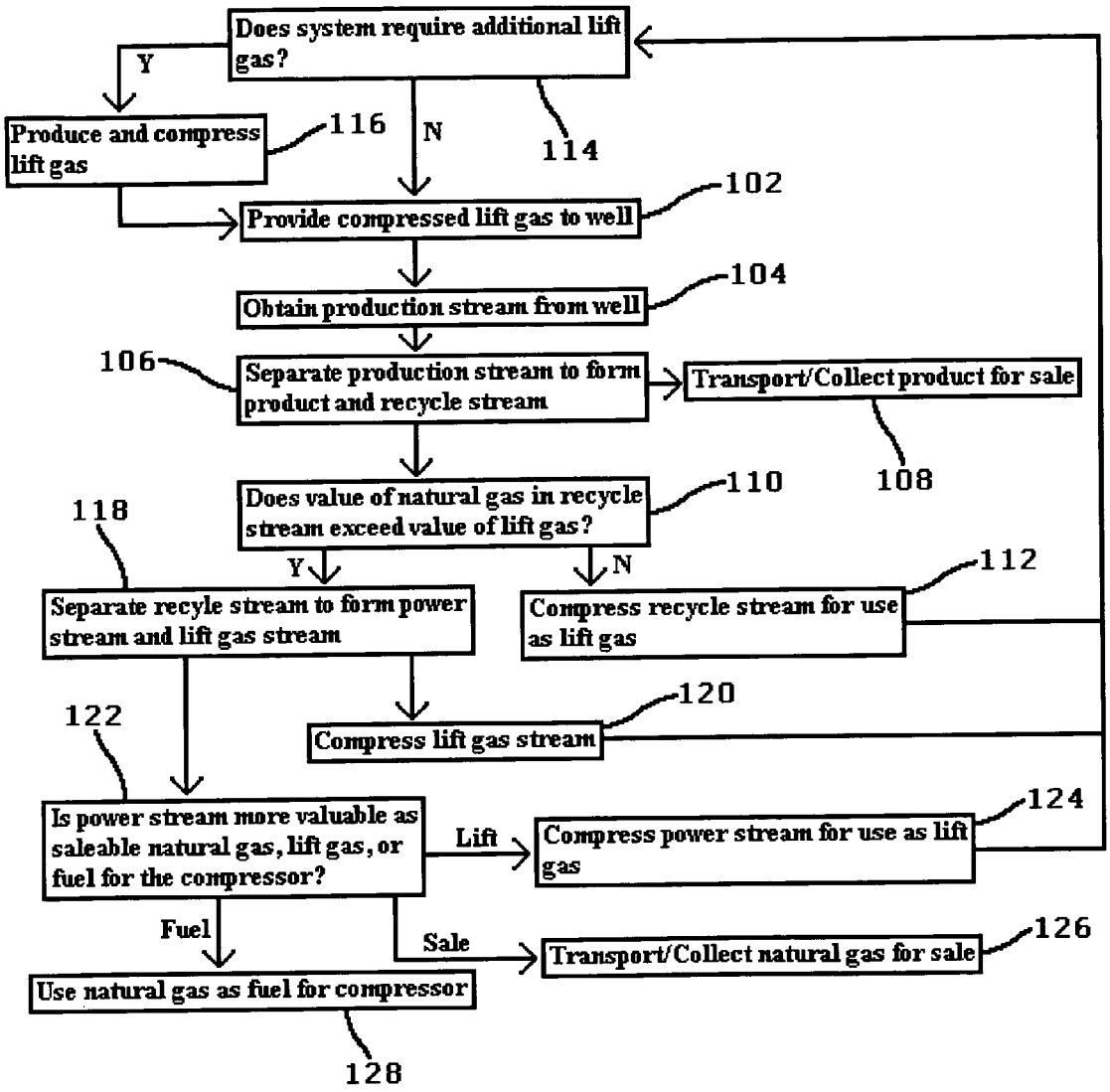
FIG. 2 depicts a diagram of an embodiment of the present method for improving production of a well.

Referring now to FIG. 2, a flow diagram of an embodiment of a self-contained method usable to improve production of a well is depicted.

At Step 102, compressed lift gas is provided into a well. The compressed lift gas can include nitrogen or another externally produced lift gas, and/or a combination of recovered and recycled streams from the well. At start-up, the compressed lift gas can consist entirely of externally generated gas, however after the present method has been performed for a period of time, a quantity of gas could be recovered from the well that is sufficient to reduce or eliminate the need for external sources of lift gas.

After providing the compressed lift gas to the well, Step 104 includes obtaining a production stream from the well. The well can be produced using any sundry manner of lift gas system known in the art, depending on the type of well and the nature of the operations undertaken. The production stream can include a desired product, such as a liquid hydrocarbon, at least a portion of the lift gas provided into the well, natural gas from the well, and one or more solid or liquid waste products and/or other gasses.

At Step 106, the production stream from the well is separated to form a product and a recycle stream. At Step 108, the product is transported and/or collected for sale.

Step 110 illustrates that regarding the recycle stream, a determination can be made. The recycle stream can contain a quantity of natural gas, entrained with at least a portion of the lift gas provided to the well. If it is determined that the value of the natural gas in the recycle stream does not exceed the cost of producing and compressing additional lift gas, then Step 112 can be performed, and the recycle stream can be compressed for use as lift gas.

At Step 114, the pressure of the system can be measured to determine whether the system requires additional lift gas. If additional lift gas is required, Step 116 can be performed, and additional lift gas can be produced and compressed for provision to the well. If no additional lift gas is required, Step 102 can be repeated using recycled lift gas from the well. Recycled lift gas from the well, in combination with recovered natural gasses from the well, is thereby usable to reduce or eliminate the need for externally produced lift gas.

If it is determined that the value of natural gas in the recycle stream may exceed the cost to produce and compress additional lift gas, Step 118 can be performed, and the recycle stream can be separated to form a power stream and a lift gas stream. It should be noted that if a sufficient quantity of gas is recovered from the well, a first portion of the recovered gas could be compressed and recycled for use as lift gas, in Step 112, while a second portion of the recovered gas could be separated as indicated at Step 118.

At step 120, the lift gas stream obtained at Step 118 is compressed for use as lift gas. If additional lift gas is required by the system, as indicated at Step 114, Step 116 can be performed to produce and compress additional lift gas. If no additional lift gas is required, the lift gas stream and/or a portion of the recycle stream can be provided to the well without generating additional gas, as indicated at Step 102.

At step 122, a determination regarding the power stream can be made. If the value of the natural gas in the power stream as a saleable commodity exceeds the cost of producing and compressing additional lift gas, and exceeds the cost of providing fuel to the compressor, the natural gas can be transported and/or collected for sale at Step 126.

If the value of the natural gas in the power stream as fuel for the compressor exceeds the value of the natural gas as a saleable commodity, and exceeds the cost of producing and compressing additional lift gas, the natural gas can be used as fuel for the compressor at Step 128.

If the cost of producing and compressing additional lift gas exceeds the cost of providing fuel to the compressor, and exceeds the value of the natural gas as a saleable commodity, Step 124 can be performed, and the power stream can be compressed for use as lift gas. A determination can then be made regarding whether additional lift gas is needed by the system, as indicated by Step 114. The compressed power stream can be combined with the compressed lift gas stream at Step 120, the recycle stream from Step 112, and/or produced lift gas from Step 116.

The present method is thereby usable to determine the most economically and practically viable use for the gas recovered from the well, and seamlessly select among the alternative uses. If a sufficient quantity of natural gas is recovered from the well, both the need for externally generated lift gas at Step 116, and the need for fuel for compression of the gas streams can be reduced or eliminated, creating a self-contained method. In situations where the collection and/or sale of the natural gas is a more economical or practical alternative, the gas can instead be sold.

While these embodiments have been described with emphasis on the embodiments, it should be understood that within the scope of the appended claims, the embodiments might be practiced other than as specifically described herein.

What is claimed is:

1. A system for increasing the production of a well, the system comprising:

a gas generator for supplying a lift gas to the well to produce a production stream from the well;

a compressor in communication with the gas generator and the well for pressurizing the lift gas;

a power source in communication with the gas generator and the compressor for selectively supplying power to the gas generator, the compressor, or combinations thereof;

a first separator for receiving and separating the production stream from the well to form a waste stream, a product stream, a recycle gas stream, or combinations thereof;

a second separator in communication with the first separator and the compressor for selectively receiving the recycle gas stream and separating the recycle gas stream to form a power stream and a lift gas stream, wherein the power stream is usable to provide power to the compressor; and at least one measuring device in communication with the compressor, the first separator, the second separator, or combinations thereof, for determining the contents, the volume, or combinations thereof, of the lift gas stream, the recycle gas stream, the power stream, or combinations thereof.

2. The system of claim 1, wherein the lift gas comprises a first gas from the gas generator, the lift gas stream from the second separator, the recycle gas stream from the first separator, or combinations thereof.

3. The system of claim 1, wherein the lift gas comprises nitrogen, natural gas, or combinations thereof.

4. The system of claim 1, wherein the power source comprises the power stream from the second separator, fuel from a fuel reservoir, or combinations thereof.

5. The system of claim 1, wherein the lift gas is compressed to a pressure ranging from 1500 pounds per square inch to 4300 pounds per square inch.

6. The system of claim 1, wherein the first compressor, the second compressor, or combinations thereof, comprise a three-phase separator, a pressure swing absorption separator, or combinations thereof.

7. The system of claim 1, further comprising a controller for selectively actuating a plurality of valves disposed between the gas generator, the compressor, the power source, the first separator, the second absorption separator, said at least one measuring device, or combinations thereof.

8. The system of claim 7, wherein the controller comprises a processor in communication with computer instructions for instructing the processor to:

selectively actuate the plurality of valves to provide power to the gas generator;

selectively actuate the plurality of valves to direct the lift gas to the well, to divert the lift gas to a lift gas collector, or combinations thereof;

selectively actuate the plurality of valves to remove the waste stream from the system;

selectively actuate the plurality of valves to direct the product to a product collector;

selectively actuate the plurality of valves to direct the recycle gas stream to the compressor, to direct the recycle gas stream to the second absorption separator, to divert the recycle gas stream to a recycle gas collector, or combinations thereof;

selectively actuate the plurality of valves to direct the power stream to a power inlet of the compressor for providing power to the compressor, to direct the power stream to a gas inlet of the compressor for compression and use as lift gas, or combinations thereof; or combinations thereof.

9. The system of claim 1, further comprising at least one transportable member for enabling the present system to be transported between wells, wherein said at least one transportable member contains the gas generator, the compressor, the power source, the first separator, the second separator, said at least one measuring device, or combinations thereof.

10. A self-contained method for increasing production of a well, the method comprising the steps of:

providing a compressed lift gas to a well to obtain a production stream from the well;

separating the production stream to form a product and a recycle gas stream;

separating the recycle gas stream to form a power stream and a lift gas stream; and using at least a portion of the power stream to provide power for compressing the lift gas stream to form the compressed lift gas for provision to the well.

11. The method of claim 10, further comprising the steps of measuring the contents of the compressed lift gas to form a measurement and selectively diverting the compressed lift gas to a lift gas collector based on the measurement.

12. The method of claim 10, further comprising the steps of measuring the volume, the contents, or combinations thereof, of the recycle gas stream to form a measurement and selectively diverting the recycle gas stream to a recycle gas collector based on the measurement.

13. The method of claim 10, further comprising the steps of measuring the contents of the power stream to form a measurement and selectively combining at least a portion of the power stream with the lift gas stream based on the measurement.

14. A system for increasing production of a well, the system comprising:

a compressor for providing a pressurized lift gas to the well to obtain a product stream;

at least one separator for receiving the product stream, wherein said at least one separator separates the product stream to form at least a power stream, and wherein said power stream provides power to the compressor;

at least one measuring device in communication with the compressor, said at least one separator, or combinations thereof, for determining the volume, the contents, or combinations thereof, of the pressurized lift gas, the product stream, said power stream, or combinations thereof; and a controller for selectively actuating a plurality of valves disposed between the compressor, said at least one separator, or combinations thereof, based on measurements obtained by said at least one measuring device, wherein the controller comprises a processor in communication with computer instructions for instructing the processor to:

selectively actuate the plurality of valves to direct the pressurized lift gas to the well, to divert the pressurized lift gas to a lift gas collector, or combinations thereof;

selectively actuate the plurality of valves to direct the power stream to a power inlet of the compressor for providing power to the compressor, to direct the power stream to a gas inlet of the compressor for compression and use as lift gas, to divert the power stream to a collector, or combinations thereof; or combinations thereof.

15. The system of claim 14, further comprising a power source in communication with the compressor for selectively supplying additional power to the compressor.

16. The system of claim 14, wherein said at least one separator separates the product stream to form said power stream, a waste stream, a product, a recycled lift gas stream, or combinations thereof, and wherein the recycled lift gas stream is provided to the compressor for pressurizing and provision to the well.

17. The system of claim 14, wherein said at least one compressor comprises a three-phase separator, a pressure swing absorption separator, or combinations thereof.

18. The system of claim 14, further comprising at least one transportable member for enabling the present system to be transported between wells, wherein said at least one transportable member contains the compressor, said at least one separator, or combinations thereof.

19. A self-contained method for increasing production of a well, the method comprising the steps of:

generating and compressing a lift gas to form a compressed lift gas;

providing the compressed lift gas to a well to obtain a production stream from the well;

separating the production stream to form a product and a recycle gas stream;

separating the recycle gas stream to form a power stream and a lift gas stream;

compressing the lift gas stream to form the compressed lift gas for provision to the well;

using at least a portion of the power stream to provide power for compressing the lift gas stream;

measuring the volume, the contents, or combinations thereof, of the compressed lift gas, the recycle gas stream, the power stream, or combinations thereof to form at least one measurement; and selectively diverting the compressed lift gas, the recycle gas stream, the power stream, or combinations thereof, to a collector based on said at least one measurement.

* * * * *